US006203398B1

(12) United States Patent
Lin

(10) Patent No.: US 6,203,398 B1
(45) Date of Patent: Mar. 20, 2001

(54) TOY ASSEMBLY HAVING TOY PIECES THAT ARE SLIDABLE ALONG A SLENDER TRACK MEMBER

(76) Inventor: Wen-Pin Lin, No. 30, Chien-Yung St., Tung Dist., Taichung City (TW)

( * ) Notice: Subject to any disclaimer, the term of this patent is extended or adjusted under 35 U.S.C. 154(b) by 0 days.

(21) Appl. No.: 09/612,121

(22) Filed: Jul. 7, 2000

(51) Int. Cl.[7] ..... A63H 33/00
(52) U.S. Cl. ..... 446/489
(58) Field of Search ..... 446/168, 169, 446/227, 489

(56) References Cited

U.S. PATENT DOCUMENTS 2,285,988 * 6/1942 Kroll ..... 446/489 X
2,817,184 * 12/1957 Inouye ..... 446/489
5,112,268 * 5/1992 Klaus ..... 446/489
5,133,684 * 7/1992 Rhodes et al. ..... 446/489

OTHER PUBLICATIONS

Brochure from Anatex Enterprises Inc., Van Nuys, CA, Feb. 1996.*

* cited by examiner

*Primary Examiner*—John A. Ricci
(74) *Attorney, Agent, or Firm*—Sheridan Ross P.C.

(57) ABSTRACT

A toy assembly includes a base member, a slender track member mounted on the base member and formed as a continuous loop, and at least one toy piece formed with a coupling hole for coupling slidably with the track member. The track member has a track groove formed continuously therealong. The toy piece further has a key projection that projects into the coupling hole and that engages slidably the track groove of the track member.

7 Claims, 3 Drawing Sheets

TOY ASSEMBLY HAVING TOY PIECES THAT ARE SLIDABLE ALONG A SLENDER TRACK MEMBER

BACKGROUND OF THE INVENTION

1. Field of the Invention

The invention relates to a toy, more particularly to a toy assembly having toy pieces that are slidable along a slender track member.

2. Description of the Related Art

Referring to FIG. 1, a conventional toy assembly is shown to include a base member 1 and a plurality of track members 2 mounted on the base member 1. Each track member 2 is in the form of an injection-molded slender tubular rod having opposite end portions 201, 202 secured to a top side 101 of the base member 1, and an intermediate winding portion between the opposite end portions 201, 202. Each of the track members 2 has a plurality of toy pieces 4 disposed thereon. Each of the toy pieces 4 is formed with a through hole 401 so as to be sleeved slidably on the respective track member 2. In use, the toy pieces 4 can be moved along the track members 2 from one of the end portions 201, 202 to the other one of the end portions 201, 202, and vice versa. The movement of the toy pieces 4 is monotonous, and a child playing with the conventional toy assembly can get bored easily.

SUMMARY OF THE INVENTION

Therefore, the object of the present invention is to provide a toy assembly of the aforesaid type which is more interesting to play with as compared to the aforesaid prior art.

According to this invention, a toy assembly comprises: a base member; a slender track member mounted on the base member and formed as a continuous loop, the track member having a track groove formed continuously therealong; and at least one toy piece formed with a coupling hole for coupling slidably with the track member, and a key projection that projects into the coupling hole and that engages slidably the track groove of the track member.

Preferably, the base member includes first and second circular plate bodies that are spaced apart from each other, and an axle body interconnecting inner wall surfaces of the plate bodies.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
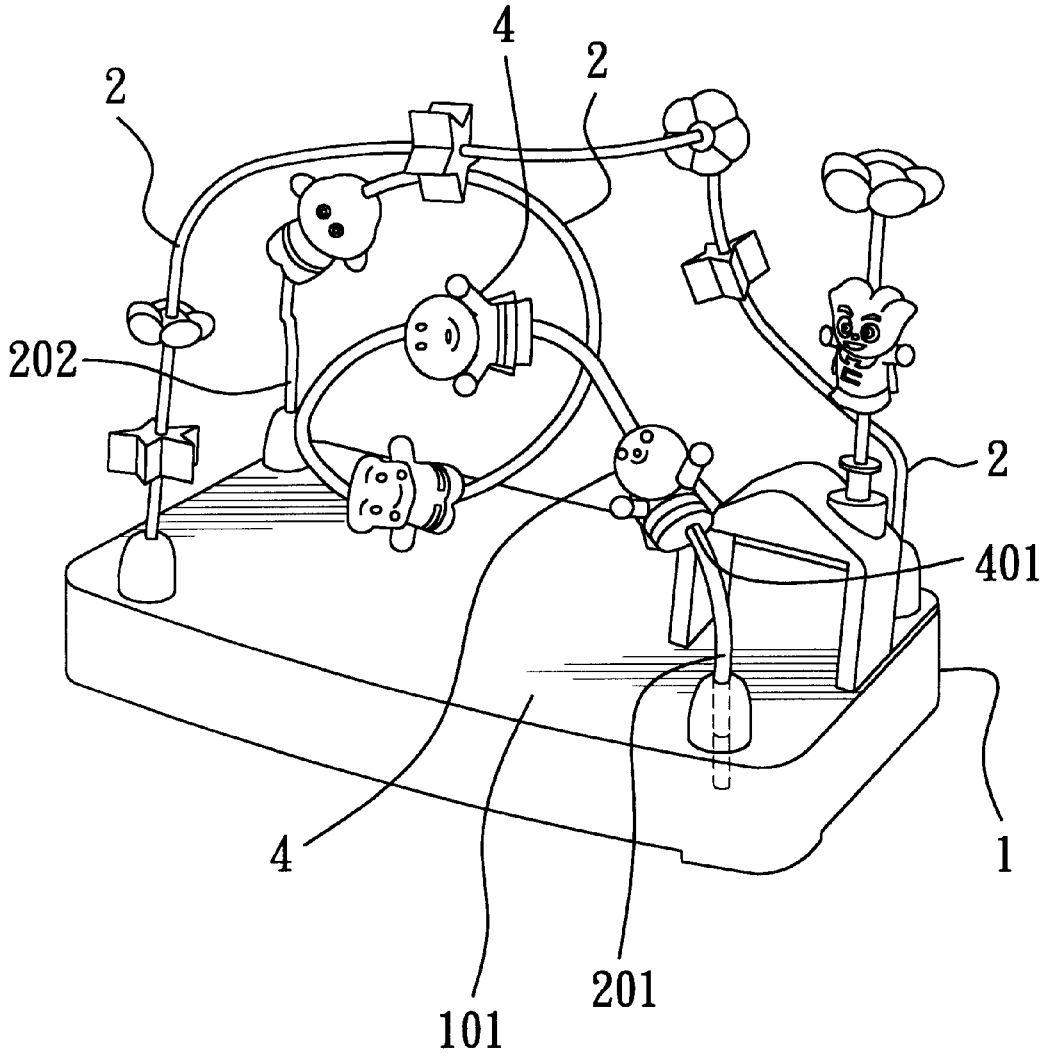
FIG. 1 PRIOR ART
FIG. 1 is a perspective view showing a conventional toy assembly.
Figure 2:
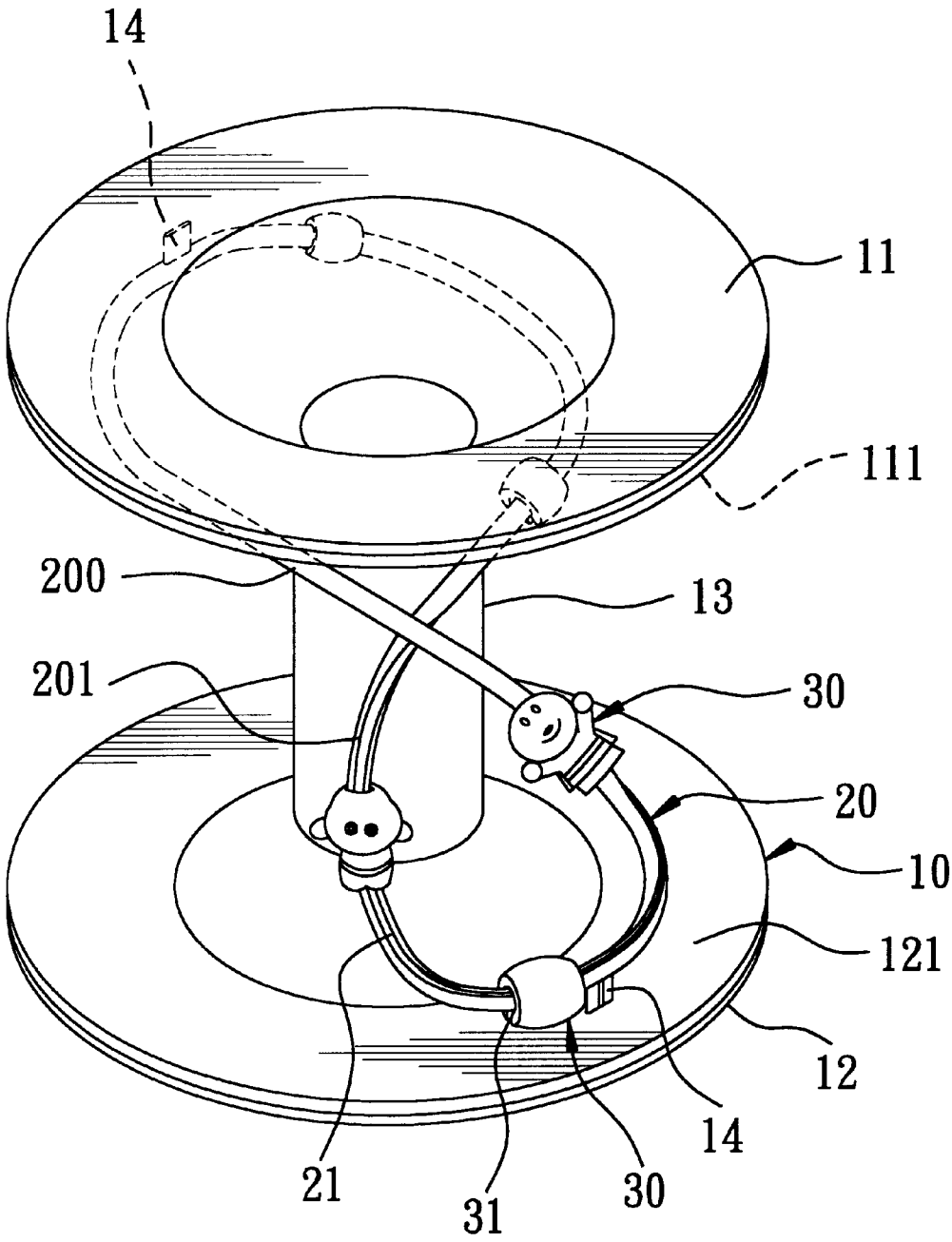
FIG. 2 is a perspective view of the preferred embodiment of a toy assembly according to the present invention.
Figure 3:
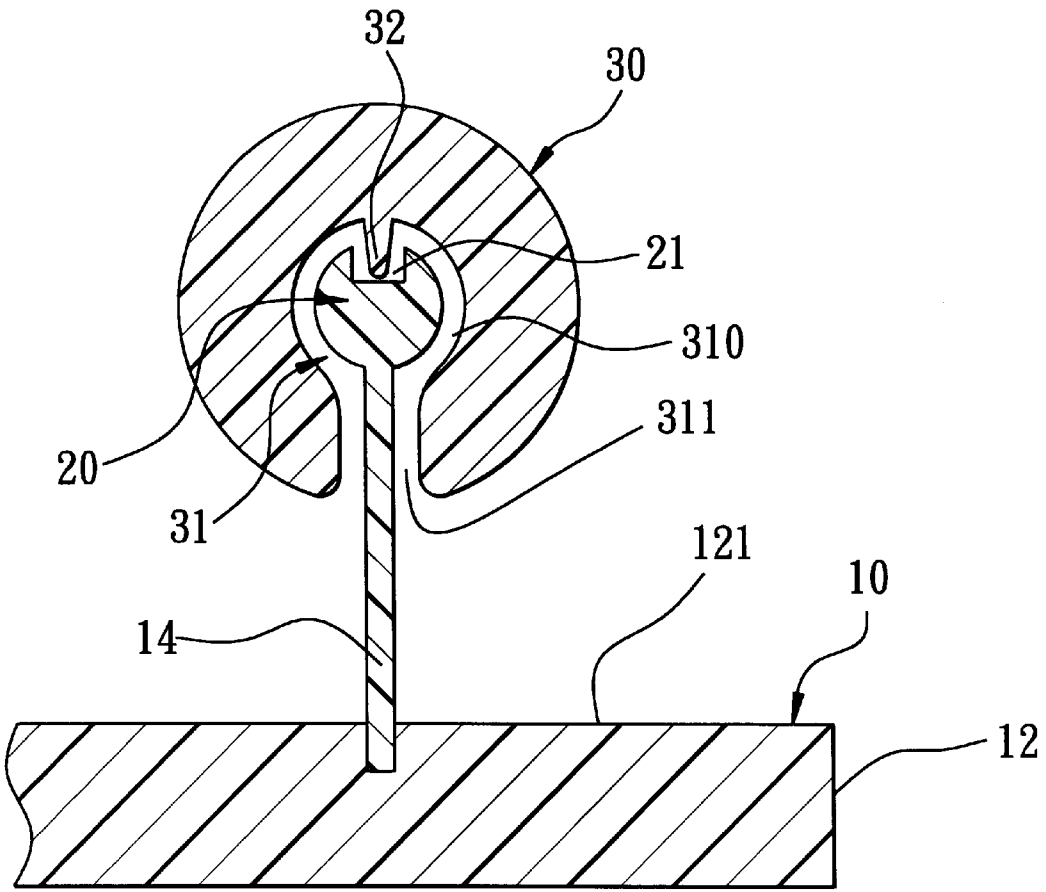
FIG. 3 is a fragmentary sectional view of the preferred embodiment.

Referring to FIGS. 2 and 3, the preferred embodiment of a toy assembly according to the present invention is shown to comprise a base member 10, a slender track member 20, and a plurality of toy pieces 30.

The base member 10 is formed as a rolling member that includes first and second circular plate bodies 11, 12 spaced apart from each other, and an axle body 13 interconnecting inner wall surfaces 111, 121 of the circular plate bodies 11, 12.

The track member 20 is made from a plastic material, such as polypropylene, and is formed as a continuous loop. In this embodiment, the track member 20 is in the shape of the number "8", and has first and second loop portions 200, 201. The axle body 13 extends through the first loop portion 200. The loop portions 200, 201 are respectively secured to the inner wall surfaces 111, 121 of the circular plate bodies 11, 12 via a protruding rib 14. The protruding ribs 14 on the circular plate bodies 11, 12 are disposed at diametrically opposite positions relative to the axle body 13, thereby retaining the track member 20 in an inclined position. The track member 20 further has a track groove 21 formed continuously therealong.

Each of the toy pieces 30 is formed with a coupling hole 31 for coupling slidably with the track member 20. The coupling hole 31 includes a central hole portion 310 that receives the track member 20, and a radial slit portion 311 that extends from the central hole portion 310 and that permits extension of the protruding rib 14 on either one of the circular plate bodies 11, 12 thereinto. Each of the toy pieces 30 is further formed with a key projection 32 that projects into the central hole portion 310 of the coupling hole 31 and that engages slidably the track groove 21 of the track member 20.

When playing with the toy assembly of this invention, either of the circular plate bodies 11, 12 of the base member 10 can be placed on a horizontal surface, and the toy pieces 30 slide along the track member 20 and move around the axle body 13. In addition, the base member 10 can be made to roll on the ground.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A toy assembly comprising:

a base member;

a slender track member mounted on said base member and formed as a continuous loop, said track member having a track groove formed continuously therealong; and at least one toy piece formed with a coupling hole for coupling slidably with said track member, and a key projection that projects into said coupling hole and that engages slidably said track groove of said track member.

2. The toy assembly of claim 1, wherein said base member includes first and second plate bodies that are spaced apart from each other, and an axle body interconnecting inner wall surfaces of said plate bodies.

3. The toy assembly of claim 2, wherein said plate bodies are circular in shape.

4. The toy assembly of claim 2, wherein said track member is in the shape of the number "8", and has first and second loop portions that are respectively secured to said inner wall surfaces of said circular plate bodies via a protruding rib.

5. The toy assembly of claim 4, wherein said protruding ribs on said plate bodies are disposed at diametrically opposite positions relative to said axle body.

6. The toy assembly of claim 4, wherein said axle body extends through one of said loop portions of said track member.

7. The toy assembly of claim 4, wherein said coupling hole includes a central hole portion that receives said track member, and a radial slit portion that extends from said central hole portion and that permits extension of said protruding rib on either one of said plate bodies thereinto.

* * * * *